US010660460B2

(12) United States Patent
Gray

(10) Patent No.: US 10,660,460 B2
(45) **Date of Patent: *May 26, 2020**

(54) DECORATIVE ARTWORK MOUNT FOR DECKS

(71) Applicant: Rodger Francis Gray, Linthicum Heights, MD (US)

(72) Inventor: Rodger Francis Gray, Linthicum Heights, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/696,209

(22) Filed: Nov. 26, 2019

(65) Prior Publication Data

US 2020/0093290 A1 Mar. 26, 2020

Related U.S. Application Data

(63) Continuation-in-part of application No. 16/194,836, filed on Nov. 19, 2018, now Pat. No. 10,532,606.

(60) Provisional application No. 62/718,140, filed on Aug. 13, 2018.

(51) Int. Cl.

| | |
|---|---|
| ***A47F 1/06*** | (2006.01) |
| ***A47G 1/06*** | (2006.01) |
| ***A47G 1/16*** | (2006.01) |

(52) U.S. Cl.

CPC ..... *A47G 1/06* (2013.01); *A47G 1/16* (2013.01); *A47G 2001/0666* (2013.01)

(58) Field of Classification Search

CPC ..... B44C 5/04; B44C 5/02; A47G 1/0627; A47G 2001/0666; A47G 2001/0677

See application file for complete search history.

(56) References Cited

U.S. PATENT DOCUMENTS

| | | | | | |
|---|---|---|---|---|---|
| 2,353,469 | A * | 7/1944 | Hopp | G09F 3/20 | 40/650 |
| 3,742,633 | A * | 7/1973 | Palm | G09F 7/08 | 40/576 |
| 3,745,680 | A * | 7/1973 | Faust | A47G 1/06 | 40/732 |
| 3,885,336 | A * | 5/1975 | Olsen | A47G 1/06 | 40/711 |
| 4,258,488 | A * | 3/1981 | Schienbein | A47G 1/06 | 40/124.2 |
| 4,884,353 | A * | 12/1989 | Taylor | G09F 7/08 | 40/611.01 |
| 5,524,370 | A * | 6/1996 | Roy | A47G 1/06 | 40/748 |

(Continued)

FOREIGN PATENT DOCUMENTS

| | | | | |
|---|---|---|---|---|
| FR | 2499839 A1 * | 8/1982 | ..... | A47G 1/06 |

*Primary Examiner* — Cassandra Davis

(57) ABSTRACT

A decorative mount includes at least a frame, a retainer trim, and a removal mechanism. The frame includes a base, a sidewall extending from a front surface of the base, and a pair of slots defined on opposing sides of an inner surface of the sidewall and spaced away from the base. The retainer trim includes an inner edge and an outer edge. The inner edge defines an opening and a pair of trim tabs extend from opposing sides of the outer edge. The trim tabs fit within the pair of slots, releasably retaining the retainer trim to the frame. The removal mechanism includes a support base disposed against the base of the frame, a lever arm including a first end and a second end, and a pivot pivotably coupling the lever arm to the support base.

8 Claims, 5 Drawing Sheets

(56) References Cited

U.S. PATENT DOCUMENTS

| | | | | |
|---|---|---|---|---|
| 6,298,593 | B1 * | 10/2001 | Vilims | A47G 1/0605<br>24/563 |
| 6,653,931 | B2 * | 11/2003 | Chiang | A47G 1/0616<br>340/286.05 |
| 8,365,452 | B2 * | 2/2013 | Goldman | A47G 1/065<br>40/771 |
| 2005/0016045 | A1 * | 1/2005 | Lasher | A47G 1/06<br>40/759 |
| 2010/0192437 | A1 * | 8/2010 | Fallander | A47G 1/06<br>40/790 |

* cited by examiner

DECORATIVE ARTWORK MOUNT FOR DECKS

CROSS-REFERENCE TO RELATED APPLICATION

This application is a continuation in part of U.S. non-provisional application Ser. No. 16/194,836, filed on Nov. 19, 2018 which claims the benefit of priority of U.S. provisional application No. 62/718,140, filed Aug. 13, 2018, the contents of which are herein incorporated by reference.

BACKGROUND OF THE INVENTION

The present invention relates to decorating decks and, more particularly, to a decorative artwork mount for decks.

An exterior deck is a flat surface capable of supporting weight, similar to a floor, but typically constructed outdoors, often elevated from the ground, and usually connected to a building. Exterior decks are made mainly using treated wood and are unadorned. Many homes have beautiful and themed designs. However, the attached decks do not compliment the home decor.

As can be seen, there is a need for a decorative artwork mount for decks that allow users to compliment their home decor.

SUMMARY OF THE INVENTION

In one aspect of the present invention, a decorative mount comprises: a frame comprising a base, a sidewall extending from a front surface of the base, and a pair of slots defined on opposing sides of an inner surface of the sidewall and spaced away from the base; a retainer trim comprising an inner edge and an outer edge, wherein the inner edge defines an opening and a pair of trim tabs extend from opposing sides of the outer edge, wherein the trim tabs fit within the pair of slots, releasably retaining the retainer trim to the frame; and a removal mechanism comprising: a support base disposed against the base; a lever arm comprising a first end and a second end; and a pivot pivotably coupling the lever arm to the support base.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a decorative artwork/imagery mounted on exterior deck posts and railings. The decorative art or images can be themed and installed on the vertical deck posts and horizontal railings. The present invention includes a frame and interchangeable decorative plates. Deck themes may be offered in many motifs and the customer can enjoy self-expression and the fulfilled compliment to their home using the present invention.

Figure 1:
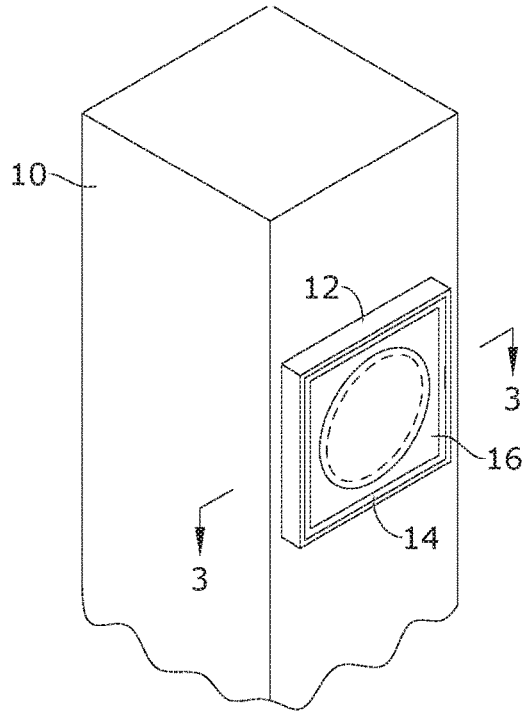
FIG. 1 is a perspective view of an embodiment of the present invention.
Figure 2:
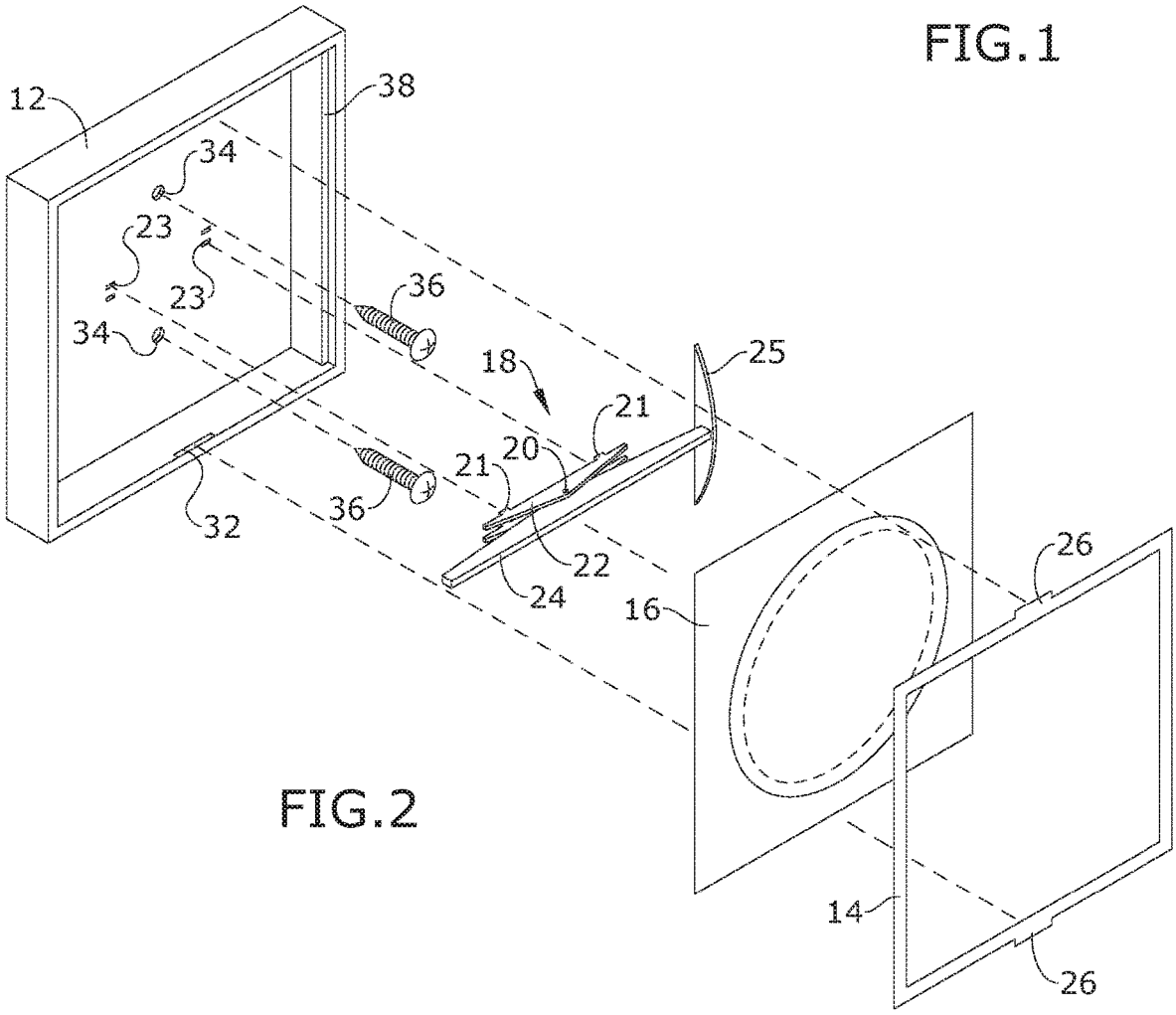
FIG. 2 is an exploded view of an embodiment of the present invention.
Figure 3:
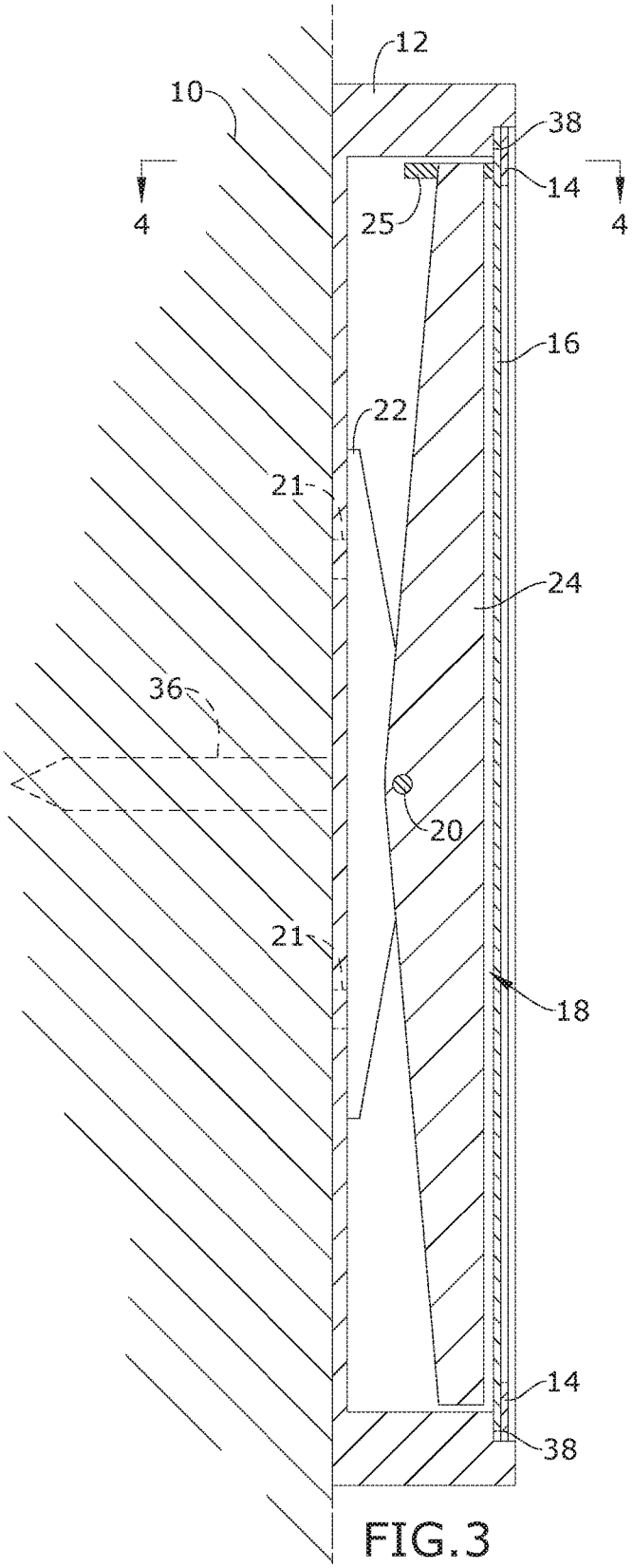
FIG. 3 is a section view of the present invention, taken along line 3-3 in FIG. 1.
Figure 4:
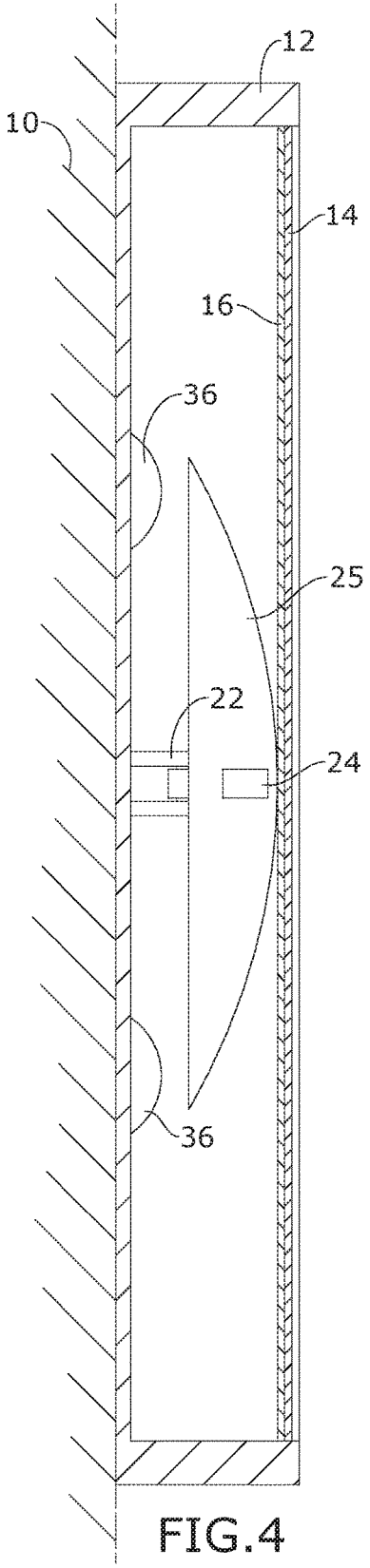
FIG. 4 is a section view of the present invention, taken along line 4-4 in FIG. 3.
Figure 5:
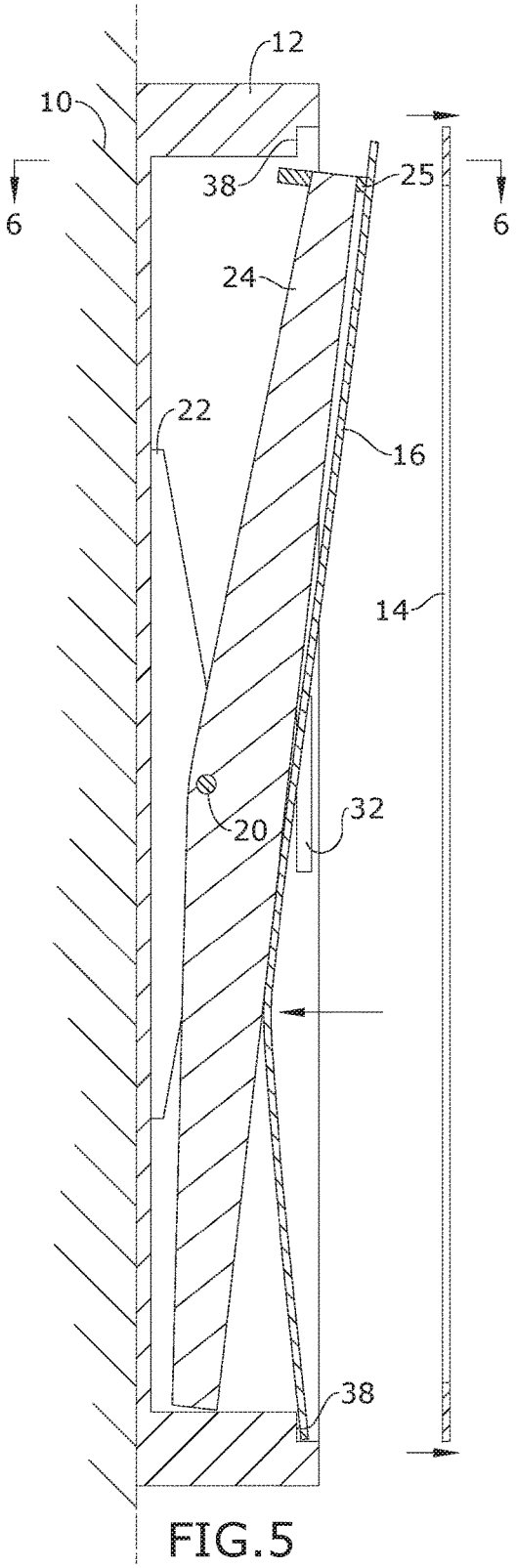
FIG. 5 is a section view of an embodiment of the present invention, illustrating removal of a decorative panel.
Figure 6:
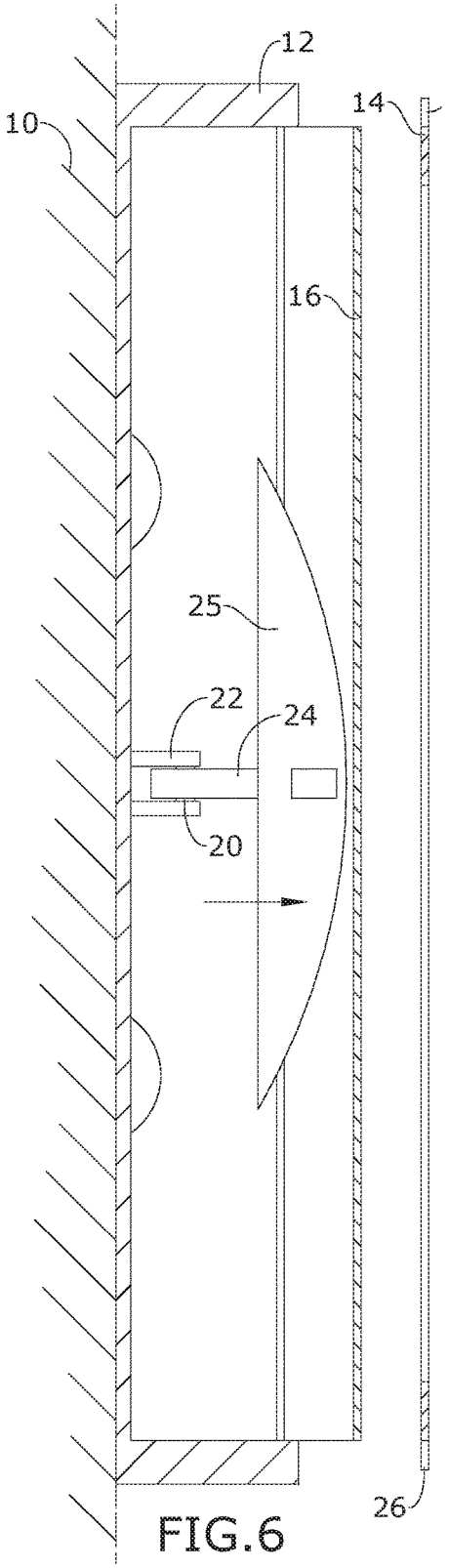
FIG. 6 is a section view of the present invention, taken along line 6-6 in FIG. 5.

Referring to FIGS. 1 through 6, the present invention includes a decorative mount. The decorative mount includes at least a frame 12, a retainer trim 14, and a removal mechanism 18. The frame 12 includes a base, a sidewall extending from a front surface of the base, and a pair of slots 32 defined on opposing sides of an inner surface of the sidewall and spaced away from the base. The retainer trim 18 includes an inner edge and an outer edge. The inner edge defines an opening and a pair of trim tabs 26 extend from opposing sides of the outer edge. The trim tabs 26 fit within the pair of slots 32, releasably retaining the retainer trim 14 to the frame 12. The removal mechanism 18 includes a support base 22 disposed against the base of the frame 12, a lever arm 24 including a first end and a second end, and a pivot pin 20 pivotably coupling the lever arm 24 to the support base 22.

The frame 12 and retainer trim 14 support a decorative plate 16. The decorative plate 16 is made of a flexible and resilient material and includes a front surface having a decoration, a rear surface, and an outer edge. The decorative plate 16 may be made of plastic or a thin and bendable metal, such as aluminum. The decoration may be made by sublimating decorative art/images onto the plastic or aluminum substrate or by printing the decoration onto waterproof printing materials. After the sublimating or printing, the decorating plate 16 may be cut to fit the frame's 12 receptacle size, such as square, rectangular, triangular, circular, and the like. To prolong the usefulness of the decorative plate 16, a UV protectant may be applied to the decoration.

The frame 12 of the present invention may also be made of a plastic or aluminum. In certain embodiments, a ledge 38 extends from at least one of the base and the sidewall of the frame 12. When the decorative plate 16 is inserted into the frame 12, the decorative plate 16 rests against the ledge 38. The frame 12 may have a shape of a square, rectangular, triangular, circular, and the like.

The retainer trim 14 is flexible in order to bend and let the tabs 26 to be placed within the pair of slots 32. The retainer trim 14 serves to secure the decorative plate 16 to the frame 12 and compliment the imagery features of the decorative plate 16.

The removal mechanism 18 is disposed within a space between the decorative plate 16 and the frame 12. The removal mechanism 18 includes the support base 22 disposed against or coupled to the base of the frame 12. For example, tabs 21 of the support base 22 may fit within slots 23 of the base of the frame 12. The removal mechanism 18 further includes the lever arm 24 having a first end and a second end abutting against a back surface of the decorative plate 16 when the decorative plate 16 is releasably retained to the frame 12. The removal mechanism 18 allows a user to easily pop the decorative panel 16 out of the frame 12 by pressing against the decorative plate 16 at the first end, pivoting the lever 12 so that the second end urges the retainer trim 14 and decorative plate 16 out of the frame 12.

At least one of the first end and the second end are disposed underneath the retainer trim 14 so that when the lever arm 24 is pivoted, the end presses against a bottom surface of the retainer trim 14. This allows a user to easily pop one side of the retainer trim 14 out, slide the decorative plate 16 out of the frame 12, and slide a new decorative plate 16 back into the frame 12. The end of the lever arm 24 may further include a curved upper edge 25. The curved upper edge 25 may be a semicircular shape and may extend perpendicular to the lever arm 24. The curved upper edge 25 presses against the bottom surface of the retainer trim 14 when the lever arm 24 is pivoted. The curved upper edge 25 allows a new decorative plate 16 to easily slide in between the retainer trim 14 and the upper edge of the sidewall of the frame 12 to be placed on the ledge 38.

The present invention may further include a fastener operable to secure the frame 12 to a post 10 of a deck. The fastener may include fastening screws 36 that are driven through openings 34 of the base of the frame 12. The installation is accomplished by using the screws 36 or other typical fasteners, such as nails, to mount the frame 12 to the post 10 or rail of the deck. The user may secure the frame 12 and then change the decorative plates 16 at any time.

Figure 7:
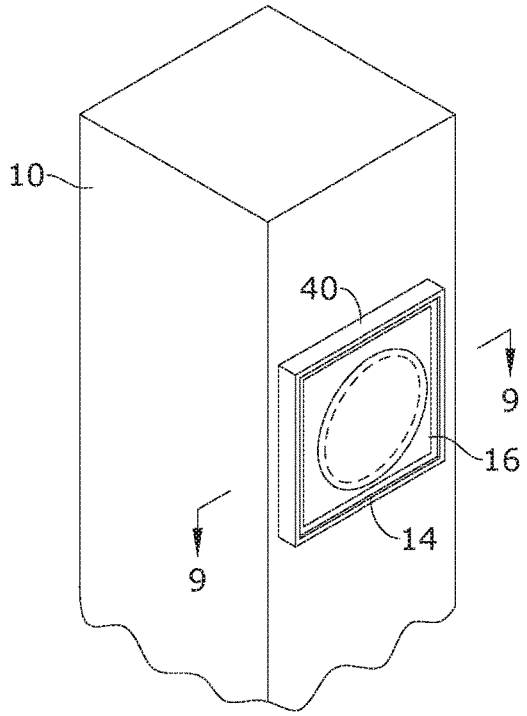
FIG. 7 is a perspective view of an embodiment of the present invention.
Figure 8:
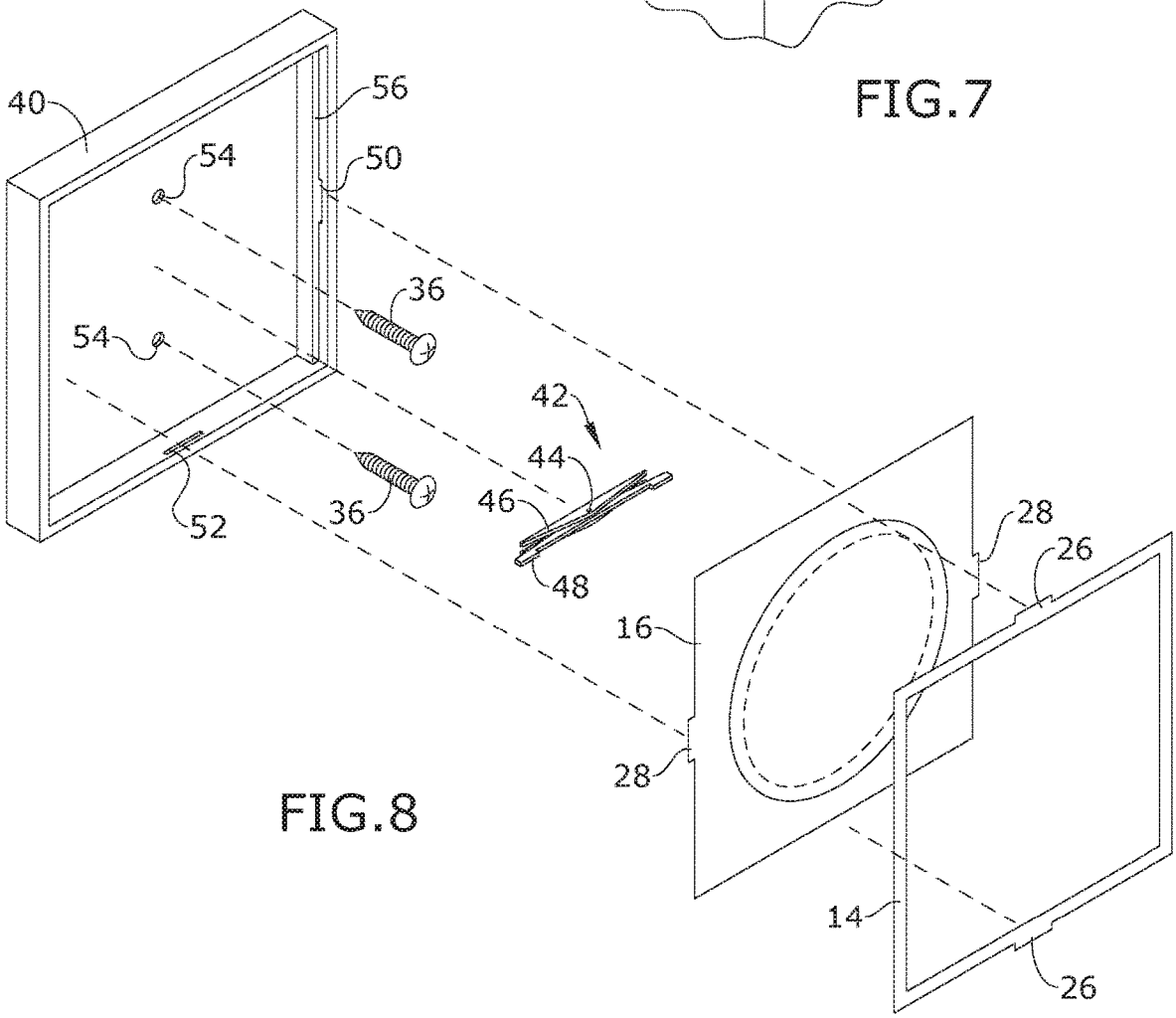
FIG. 8 is an exploded view of an embodiment of the present invention.
Figure 9:
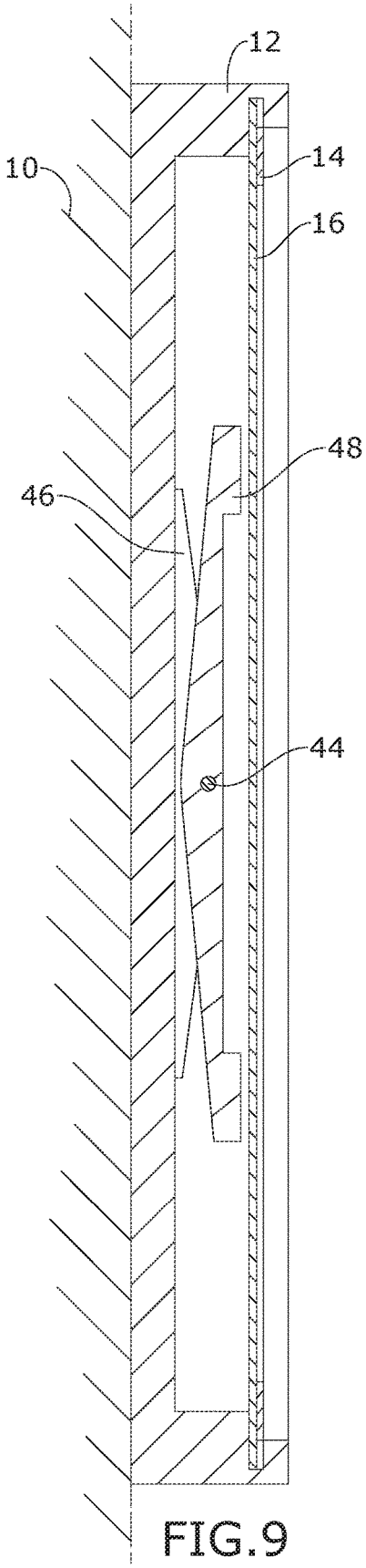
FIG. 9 is a section view of the present invention, taken along line 9-9 in FIG. 7.
Figure 10:
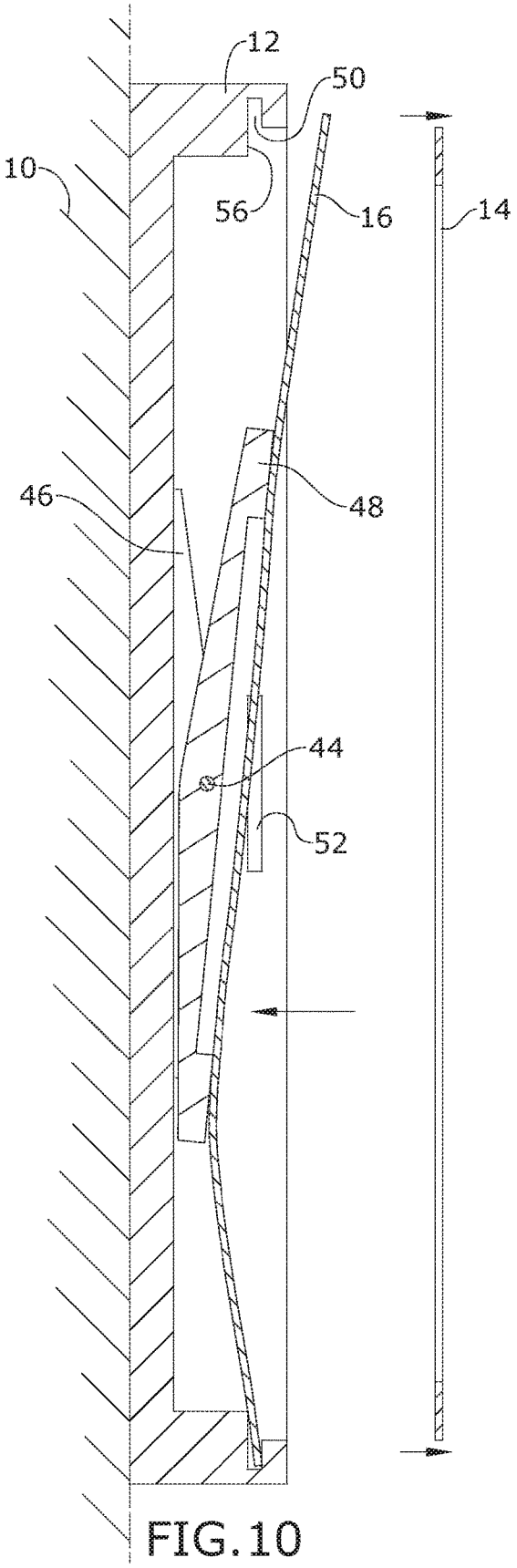
FIG. 10 is a section view of an embodiment of the present invention, illustrating removal of a decorative panel.

Referring to FIGS. 7 through 10, the present invention includes a decorative mount. The decorative mount includes at least a frame 40 and a decorative plate 16. The frame 40 includes a base, a sidewall extending from a front surface of the base, and a first pair of slots 50 defined on opposing sides of an inner surface of the sidewall and spaced away from the base. The decorative plate 16 is made of a flexible and resilient material and includes a front surface having a decoration, a rear surface, an outer edge, and a pair of plate tabs 28 extending from opposing sides of the outer edge. The pair of plate tabs 28 fit within the first pair of slots 50, releasably retaining the decorative plate 16 to the frame 40. A space is defined between the decorative plate 16 and the base.

As mentioned above, the decorative plate 16 is made of a flexible and resilient material. For example, the decorative plate 16 may be made of plastic or a thin and bendable metal, such as aluminum. Therefore, the decorative plate 16 may be bent to insert into the frame 40 and removed from the frame 12. The decoration may be made by sublimating decorative art/images onto the plastic or aluminum substrate or by printing the decoration onto waterproof printing materials. After the sublimating or printing, the decorating plate 16 may be cut to fit the frame's 40 receptacle size, such as square, rectangular, triangular, circular, and the like. To prolong the usefulness of the decorative plate 16, a UV protectant may be applied to the decoration.

The frame 40 of the present invention may also be made of a plastic or aluminum. In certain embodiments, a ledge 56 extends from at least one of the base and the sidewall of the frame 40. When the decorative plate 16 is inserted into the frame 12, the decorative plate 16 rests against the ledge 56. The frame 12 may have a shape of a square, rectangular, triangular, circular, and the like.

The present invention may further include a retainer trim 14. The retainer trim 14 includes an inner edge and an outer edge. The inner edge defines an opening providing a clearance for the decoration. A pair of trim tabs 26 extend from opposing sides of the outer edge. The trim tabs 26 fit within a second pair of slots 52 defined on opposing sides of an inner surface of the sidewall, releasably retaining the retainer trim 14 to the frame 40 so that the decorative plate 16 is disposed in between the retainer trim 14 and the base. The retainer trim 14 is flexible in order to bend and let the tabs 26 to be placed within the second pair of slots 52. The retainer trim 14 further retains the decorative plate 16 to the frame 40.

The present invention may further include a removal mechanism 42 disposed within the space between the decorative plate 16 and the frame 40. The removal mechanism 42 includes a support base 46 disposed against or coupled to the base of the frame 40. The removal mechanism 42 further includes a lever arm 48 having a first end and a second end abutting against a back surface of the decorative plate 16 when the decorative plate 16 is releasably retained to the frame 12. A pivot pin 44 pivotably couples the lever arm 48 to the support base 46 at a central portion of the lever arm 48. The removal mechanism 42 allows a user to easily pop the decorative panel 16 out of the frame 40 by pressing against the decorative plate 16 at the first end, pivoting the lever 48 so that the second end urges the decorative plate 16 out of the frame 40.

The present invention may further include a fastener operable to secure the frame 40 to a post 10 of a deck. The fastener may include fastening screws 36 that are driven through openings 54 of the base of the frame 40. The installation is accomplished by using the screws 36 or other typical fasteners, such as nails, to mount the frame 40 to the post 10 or rail of the deck. The user may secure the frame 40 and then change the decorative plates 16 at any time.

In alternate embodiments, the present invention may be used for at hotel swimming pools that have railings or fencing. Local vendors may use the present invention to advertise their goods, sales events, or location of service. The present invention may be used for festivities and celebratory occasions as well, such as 4th of July, Birthdays, Graduations, and the like. The present invention may further be used for promoting professional sports, musicians, and other artists.

It should be understood, of course, that the foregoing relates to exemplary embodiments of the invention and that modifications may be made without departing from the spirit and scope of the invention as set forth in the following claims.

What is claimed is:

1. A decorative mount comprising:

a frame comprising a base, a sidewall extending from a front surface of the base, and a pair of slots defined on opposing sides of an inner surface of the sidewall and spaced away from the base;

a retainer trim comprising an inner edge and an outer edge, wherein the inner edge defines an opening and a pair of trim tabs extend from opposing sides of the outer edge, wherein the pair of trim tabs fit within the pair of slots, releasably retaining the retainer trim to the frame; and a removal mechanism comprising:

a support base disposed against the base;

a lever arm comprising a first end and a second end; and a pivot pivotably coupling the lever arm to the support base.

2. The decorative mount of claim 1, wherein at least one of the first end and the second end are disposed underneath the retainer trim so that when the lever arm is pivoted the at least one of the first end and the second end presses against a bottom surface of the retainer trim.

3. The decorative mount of claim 2, wherein the at least one of the first end and the second end comprises a curved upper edge, wherein the curved upper edge presses against the bottom surface of the retainer trim when the lever arm is pivoted.

4. The decorative mount of claim 1, wherein the frame and the retainer trim comprise a quadrilateral shape.

5. The decorative mount of claim 1, further comprising a fastener operable to secure the frame to a post of a deck.

6. The decorative mount of claim 5, wherein the fastener comprises screws driven through openings of the base.

7. The decorative mount of claim 1, further comprising a ledge extending from at least one of the base and the frame.

8. The decorative mount of claim 7, further comprising a decorative panel resting on the ledge and disposed in between the retainer trim and the removal mechanism.

* * * * *